US010825591B2

(12) United States Patent
Nanbara et al.

(10) Patent No.: US 10,825,591 B2
(45) Date of Patent: Nov. 3, 2020

(54) COMPOSITE MATERIAL MOLDED ARTICLE AND REACTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Shintaro Nanbara, Mie (JP); Takashi Takada, Mie (JP); Kazushi Kusawake, Mie (JP)

(73) Assignees: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-Shi, Osaka (JP)

( * ) Notice: Subject to any disclaimer, the term of this patent is extended or adjusted under 35 U.S.C. 154(b) by 123 days.

(21) Appl. No.: 15/752,782

(22) PCT Filed: Aug. 12, 2016

(86) PCT No.: PCT/JP2016/073705
§ 371 (c)(1),
(2) Date: Feb. 14, 2018

(87) PCT Pub. No.: WO2017/030084
PCT Pub. Date: Feb. 23, 2017

(65) Prior Publication Data

US 2018/0240578 A1 Aug. 23, 2018

(30) Foreign Application Priority Data

Aug. 20, 2015 (JP) ..... 2015-163251

(51) Int. Cl.
*H01F 17/04* (2006.01)
*H01F 1/147* (2006.01)
(Continued)

(52) U.S. Cl.
CPC ..... *H01F 1/14766* (2013.01); *H01F 1/26* (2013.01); *H01F 27/255* (2013.01);
(Continued)

(58) Field of Classification Search
CPC .. H01F 1/14766; H01F 41/061; H01F 27/255; H01F 27/2823; H01F 41/0246
(Continued)

(56) References Cited

U.S. PATENT DOCUMENTS

2012/0133470 A1* 5/2012 Fujiyama ..... H01F 27/255 336/192
2013/0127579 A1* 5/2013 Ueno ..... H01F 37/00 336/212
(Continued)

FOREIGN PATENT DOCUMENTS

JP 63-124537 5/1988
JP 63-289849 11/1988
(Continued)

OTHER PUBLICATIONS

Search Report for PCT/JP2016/073705, dated Oct. 25, 2016.

*Primary Examiner* — Jianchun Qin
(74) *Attorney, Agent, or Firm* — Honigman LLP

(57) ABSTRACT

Provided is a composite material molded article including soft magnetic powder and resin containing the soft magnetic powder in a dispersed state. The composite material molded article includes a parting line corresponding to a parting surface of a mold for molding the composite material molded article, and an inner core portion to be arranged inside a coil. A peripheral surface includes surfaces along a
(Continued)

circumferential direction of a magnetic flux excited in the inner core portion by the coil, and the parting line is formed to split a peripheral direction of the peripheral surface.

7 Claims, 2 Drawing Sheets

(51) Int. Cl.

| | |
|---|---|
| ***H01F 27/255*** | (2006.01) |
| ***H01F 37/00*** | (2006.01) |
| ***H01F 1/26*** | (2006.01) |
| ***H01F 27/30*** | (2006.01) |
| ***H01F 41/061*** | (2016.01) |
| ***H01F 27/28*** | (2006.01) |
| ***H01F 41/02*** | (2006.01) |

(52) U.S. Cl.
CPC ..... *H01F 27/2823* (2013.01); *H01F 27/306* (2013.01); *H01F 37/00* (2013.01); *H01F 41/0246* (2013.01); *H01F 41/061* (2016.01)

(58) Field of Classification Search
USPC ..... 336/221
See application file for complete search history.

(56) References Cited

U.S. PATENT DOCUMENTS

| | | | | |
|---|---|---|---|---|
| 2014/0160819 | A1* | 6/2014 | Inaba | H01F 1/26 363/123 |
| 2014/0232508 | A1* | 8/2014 | Inaba | H01F 37/00 336/233 |

FOREIGN PATENT DOCUMENTS

| | | | |
|---|---|---|---|
| JP | H04-213841 | A | 8/1992 |
| JP | 2013-131676 | A | 7/2013 |
| JP | 2015-026819 | A | 2/2015 |

* cited by examiner

COMPOSITE MATERIAL MOLDED ARTICLE AND REACTOR

CROSS-REFERENCE TO RELATED APPLICATIONS

This application is the U.S. national stage of PCT/JP2016/073705 filed Aug. 12, 2016, which claims priority of Japanese Patent Application No. JP 2015-163251 filed Aug. 20, 2015.

TECHNICAL FIELD

The present invention relates to a reactor.

BACKGROUND

A core piece made of a composite material (composite material molded article) containing magnetic powder and resin is used in the reactor disclosed in JP 2014-239120A, for example. The core piece includes coil insertion portions (inner core portions) to be inserted into a coil, and an exposed portion (outer core portion) that is formed integrally with the coil insertion portions and is to be arranged on the outside of the coil to cover at least a portion of an end surface of the coil. The core piece is manufactured by filling a mold with a mixture of magnetic powder and resin and solidifying (curing) the resin. A mold from which a core piece is removed in a direction along the longitudinal direction of the coil insertion portions, that is, in a direction parallel to a magnetic flux excited by the coil, is used as the mold for manufacturing the core piece.

The composite material molded article of the present disclosure is a composite material molded article including soft magnetic powder and resin containing the soft magnetic powder in a dispersed state. The composite material molded article includes: a parting line corresponding to a parting surface of a mold for molding the composite material molded article, and an inner core portion to be arranged inside a coil, wherein a peripheral surface includes surfaces along a circumferential direction of a magnetic flux excited in the inner core portion by the coil among surfaces of the inner core portion, and the parting line is formed to split a peripheral direction of the peripheral surface.

The reactor of the present disclosure is a reactor including a coil and a magnetic core. The coil is obtained by winding a winding wire, and the coil is disposed around the magnetic core, wherein at least a portion of the magnetic core includes the above-mentioned composite material molded article of the present disclosure.

DETAILED DESCRIPTION OF PREFERRED EMBODIMENTS

Figure 1:
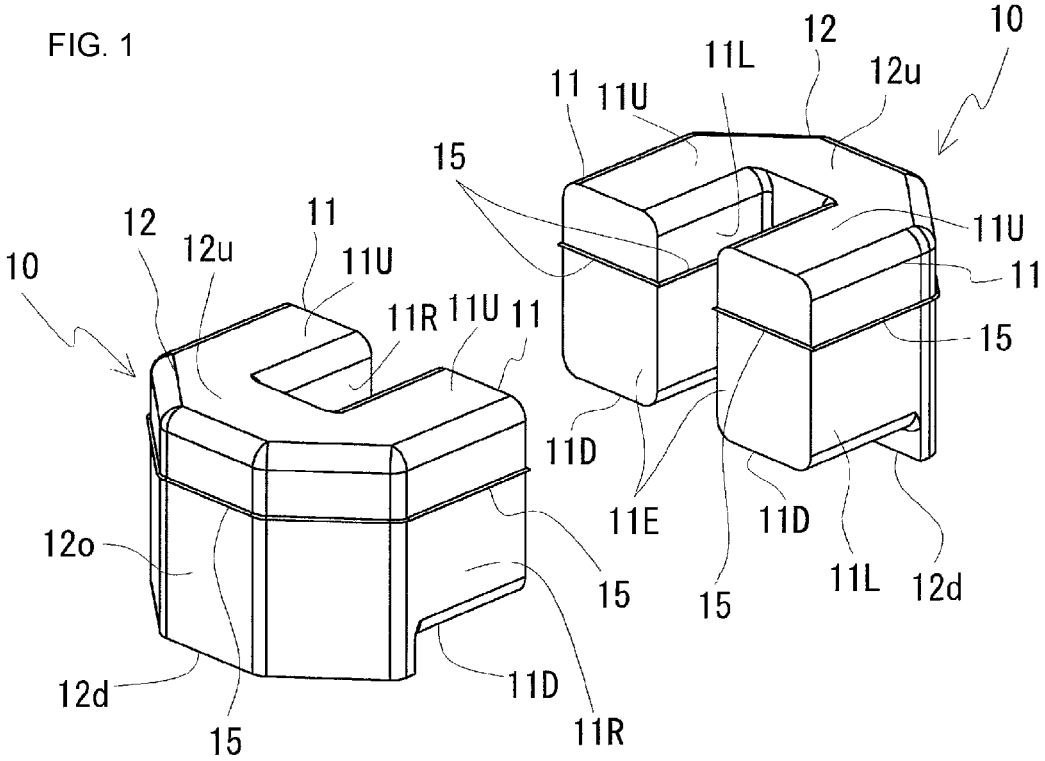
FIG. 1 shows diagrams of a composite material molded article according to Embodiment 1. The left diagram is a schematic perspective view as viewed from the outer end surface side, and the right diagram is a schematic perspective view as viewed from the interlinkage surface side.

It has been desired that loss in a reactor including a core constituted by a composite material molded article is further reduced.

Therefore, an object of the present invention is to provide a composite material molded article that can be used to form a low-loss reactor.

In addition, another object of the present invention is to provide a reactor including the above-mentioned composite material molded article.

Advantageous Effects of the Present Disclosure

The composite material molded article of the present disclosure can be used to form a low-loss reactor.

The reactor of the present disclosure is a low-loss reactor.

Description of Embodiments of the Present Invention

The inventors of the present invention examined factors that inhibit a reduction in loss in a conventional composite material molded article manufactured using a mold from which a core piece is removed in a direction along the longitudinal direction of the inner core portion. As a result, the following findings were obtained.

A film-like conductive portion in which soft magnetic particles are spread and electrical conduction is established between the magnetic particles is formed in a region of the composite material molded article that has come into sliding contact with the inner surface of the mold during mold removal.

In general, the content of resin in the composite material molded article is larger than that in a powder molded article obtained through press-molding of soft magnetic powder. Therefore, it has been thought that the soft magnetic particles are less likely to be spread due to sliding contact with the inner surface of the mold during mold removal, and a film-like conductive portion in which electric conduction is established between the soft magnetic particles is thus less likely to be formed, unlike a powder molded article. However, a conductive portion is formed even in such a composite material molded article.

Since the composite material molded article is removed from the mold in the direction parallel to a magnetic flux excited by a coil, conductive portions are formed on all of the surfaces of the composite material molded article that are parallel to the magnetic flux, and an eddy current flows in the circumferential direction about the magnetic flux.

The conductive portions are formed not to the extent that they have no influence on a loss increase and can be substantially ignored, but to the extent that they have a significant influence on a loss increase, that is, a significant eddy current loss is generated.

The conductive portions are formed even when soft magnetic powder containing Fe-based alloy particles, which are harder and less likely to be spread than pure iron, is used.

The inventors of the present invention intensively investigated a method for manufacturing a composite material molded article, specifically a mold removal direction, based on these findings, and thus achieved the present invention. First, embodiments of the present invention will be listed and described.

(1) A composite material molded article according to an aspect of the present invention is a composite material molded article including soft magnetic powder and resin containing the soft magnetic powder in a dispersed state.

The composite material molded article includes a parting line corresponding to a parting surface of a mold for molding the composite material molded article, and an inner core portion to be arranged inside a coil, wherein a peripheral surface includes surfaces along a circumferential direction of a magnetic flux excited in the inner core portion by the coil among surfaces of the inner core portion, and the parting line is formed to split a peripheral direction of the peripheral surface.

With the above-mentioned configuration, a low-loss reactor can be formed. The reason for this is that an eddy current flowing in the peripheral direction of the peripheral surface can be made less likely to flow in the peripheral surface extending in the circumferential direction of the magnetic flux and thus be blocked, leading to a reduction in eddy current loss. In the case where the mold removal direction is parallel to the magnetic flux, the entire region of the peripheral surface of the inner core portion comes into sliding contact with the inner surface of the mold. Therefore, the soft magnetic particles are spread, and the film-like conductive portions in which electrical conduction is established between the soft magnetic particles are thus formed on the entire peripheral surface. An eddy current flows in the peripheral direction of the peripheral surface due to the conductive portions, and therefore, eddy current loss increases. In contrast, with the above-mentioned configuration, the parting line is formed to split the peripheral direction of the peripheral surface. Therefore, only a partial region of the peripheral surface comes into sliding contact, and non-sliding contact regions that do not come into sliding contact are respectively formed on two portions separated by the parting line. The reason for this is that the mold removal direction is orthogonal to the parting line. Substantially no conductive portions are formed in the non-sliding contact regions, thus making it possible to block an eddy current flowing in the peripheral direction of the peripheral surface. Therefore, eddy current loss can be reduced.

(2) An embodiment of the above-mentioned composite material molded article includes a remelted trace of the resin formed on at least a portion of the parting line.

With the above-mentioned configuration, when a reactor is formed by assembling the composite material molded article in a coil, the contact between the remelted trace and the coil is easily suppressed. Therefore, damage to the conductor of the winding wire of the coil or an insulating coating with which the surface of the conductor may be coated, due to the contact therebetween, is easily suppressed. In addition, the remelted trace and the coil can be sufficiently spaced apart, thus making it easy to insulate the composite material molded article from the coil. The reason for this is that the remelted trace is formed by heating the parting line, and thus has a height lower than the protruding height of the parting line protruding outward from the surfaces of the composite material molded article.

Moreover, with the above-mentioned configuration, the adhesion (joining properties) between the surfaces of the composite material molded article and resin covering the surfaces is easily increased. The reason for this is that the remelted trace is formed through heat treatment, and the surface roughness thereof is thus easily increased compared to that prior to the heat treatment, thus making it possible to increase the contact area of the remelted trace and the resin. When the composite material molded article is used as the magnetic core of a reactor, resin molded portions may be formed on the surfaces of the composite material molded article in order to increase the insulation between the surfaces of the composite material molded article and the coil.

Furthermore, with the above-mentioned configuration, the generation of rust on the soft magnetic powder can be suppressed. The reason for this is that even if the soft magnetic powder is exposed on the parting line, the resin can be fluidized through heat treatment performed on the parting line when the remelted trace is formed, thus making it possible to embed the exposed soft magnetic powder in the resin.

(3) An embodiment of the above-mentioned composite material molded article includes a breakage trace formed on at least a portion of the parting line.

With the above-mentioned configuration, when a reactor is formed by assembling the composite material molded article in a coil, damage to the coil or the insulating coating of the coil is easily suppressed, and, in addition, the composite material molded article is easily insulated from the coil. Moreover, the adhesion (joining properties) between the surfaces of the composite material molded article and resin covering the surfaces is easily increased.

(4) An embodiment of the above-mentioned composite material molded article includes a pair of the inner core portions arranged in parallel, and an outer core portion that is to be arranged outside the coil and that connects the inner core portions, wherein the peripheral surface on which the parting line extends is orthogonal to a direction in which the pair of the inner core portions are arranged in parallel.

With the above-mentioned configuration, a low-loss reactor in which an eddy current is less likely to flow can be formed.

(5) In an embodiment of the above-mentioned composite material molded article, the soft magnetic powder contains soft magnetic particles made of an Fe-based alloy that contains Si in an amount of 1.0 mass % or more and 8.0 mass % or less.

The Fe-based alloy containing Si in an amount of 1.0 mass % or more has a high electric resistivity and makes it easy to reduce eddy current loss. In addition, such an Fe-based alloy is harder than pure iron. Therefore, distortion is less likely to occur during a manufacturing process, and hysteresis loss is thus easily reduced, thus making it possible to further reduce iron loss. Regarding the Fe-based alloy containing Si in an amount of 8.0 mass % or less, the amount of Si is not excessively large, and both low loss and high saturation magnetization are easily achieved.

(6) In an embodiment of the above-mentioned composite material molded article, the soft magnetic powder is contained in the composite material molded article in an amount of 30 vol % or more and 80 vol % or less with respect to the whole amount of the composite material molded article.

When the above-mentioned content is 30 vol % or more, the ratio of the magnetic component is sufficiently high. Therefore, when this composite material molded article is used to form a reactor, saturation magnetization is easily increased. The larger the above-mentioned content is, the smaller the content of the resin is. Therefore, the conductive portions in which electrical conduction is established between the particles are likely to be formed in the above-mentioned sliding contact regions. However, when the above-mentioned non-sliding contact regions are included, eddy current loss can be reduced. When the above-mentioned content is 80 vol % or less, the ratio of the magnetic component is not excessively high, and therefore, the insulation between the soft magnetic particles can be increased, thus making it possible to reduce eddy current loss.

(7) In an embodiment of the above-mentioned composite material molded article, the soft magnetic powder has an average particle diameter of 5 μm or more and 300 μm or less.

When the soft magnetic powder has an average particle diameter of 5 μm or more, the soft magnetic powder is less likely to coagulate, and resin is easily provided between the powder particles, thus making it easy to reduce eddy current loss. When the soft magnetic powder has an average particle diameter of 300 μm or less, the size of the soft magnetic powder is not excessively large. Therefore, eddy current loss of the powder particles can be reduced, and eddy current loss of the composite material molded article can be thus reduced. In addition, the filling factor can be increased, and the saturation magnetization of the composite material molded article is easily increased.

A reactor according to an aspect of the present invention is a reactor including: a coil and a magnetic core. The coil obtained by winding a winding wire; and the coil is arranged around the magnetic core, wherein at least a portion of the magnetic core includes the composite material molded article according to any one of the items (1) to (7).

With the above-mentioned configuration, the reactor includes the above-mentioned composite material molded article in which eddy current loss can be effectively reduced, and thus serves as a low-loss reactor.

Details of Embodiments of the Present Invention

Hereinafter, details of embodiments of the present invention will be described with reference to the drawings.

Embodiment 1

Composite Material Molded Article

A composite material molded article 10 according to Embodiment 1 will be described with reference to mainly FIG. 1. The composite material molded article 10 is obtained by solidifying (curing) resin in an unsolidified mixture containing soft magnetic powder and the resin, and typically constitutes at least a portion of a magnetic core provided in a reactor. Although details will be specifically described later, the reactor includes a coil 2 and a magnetic core 3 shown in FIG. 2, for example. In this specification, the coil 2 is obtained by connecting in parallel a pair of wound portions 2*a* and 2*b* that are each obtained by spirally winding a winding wire 2*w*. The magnetic core 3 is configured to have an annular shape by combining two core members 30 having the same shape. Both of the core members 30 are made of the composite material molded article 10. The composite material molded article 10 is manufactured by filling a cavity of a mold with a composite material in a fluid state through a gate and solidifying the resin. One feature of the composite material molded article 10 is that a parting line 15 is formed to split the peripheral surface, which extends in the circumferential direction of a magnetic flux, of an inner core portion 11 to be arranged inside the coil 2. Specifically, the composite material molded article 10 can be manufactured using a mold that has a parting surface extending in parallel to the magnetic flux, that is, a mold in which the mold removal direction is orthogonal to the magnetic flux. Hereinafter, details will be described. In this specification, a reactor 1 is formed by assembling the core members 30 in the coil 2, and when the reactor 1 is installed on an installation target such as a cooling base, the installation target side is referred to as "lower side", and a side opposite to the installation target is referred to as "upper side" in the following description. In the figures, components having the same name are denoted by the same reference numeral.

Overall Configuration

Figure 2:
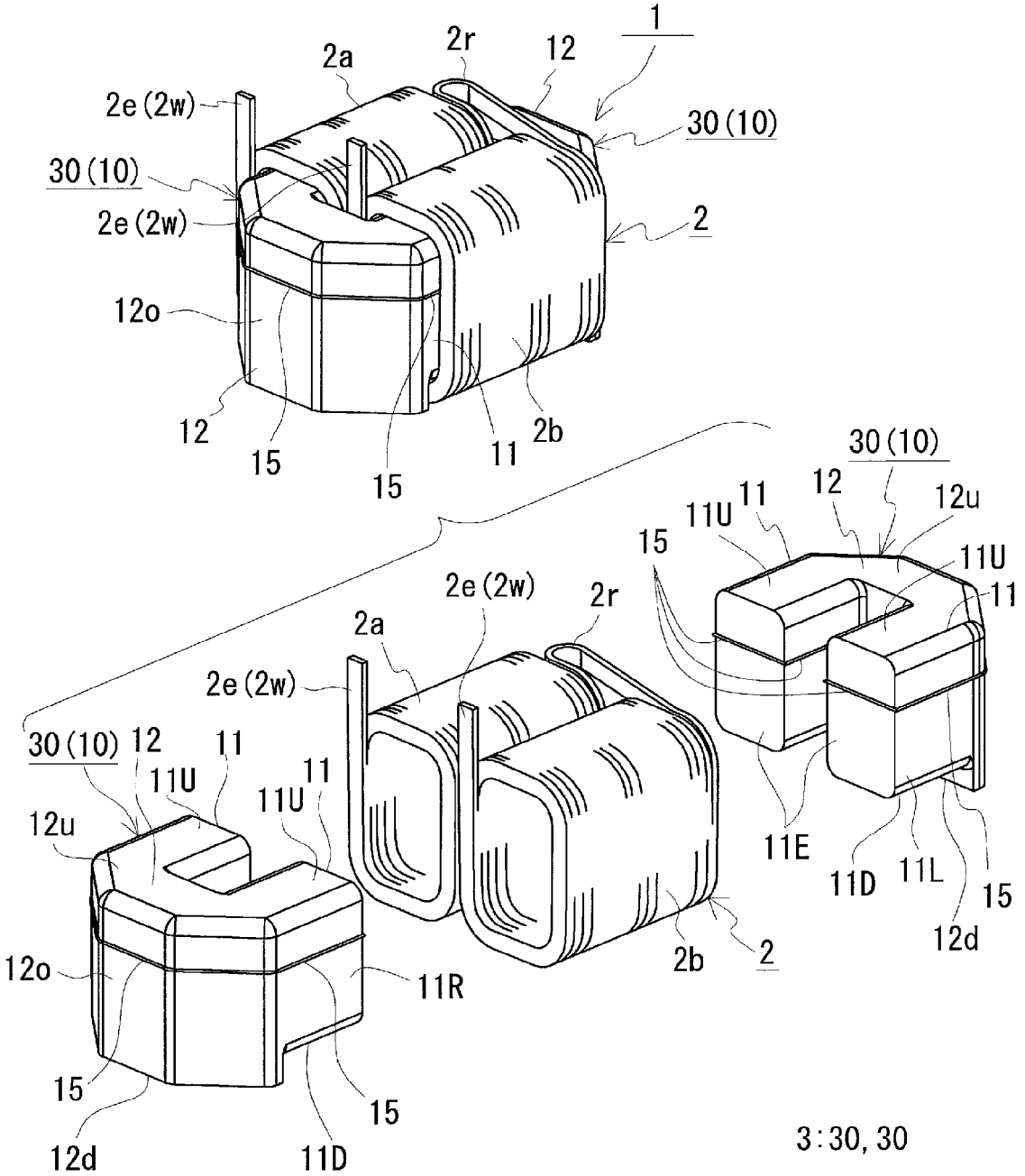
FIG. 2 shows diagrams of a reactor according to Embodiment 1. The upper diagram is a schematic perspective view, and the lower diagram is an exploded perspective view.

The composite material molded article 10 includes a pair of inner core portions 11, and an outer core portion 12 that connects the ends on one side of the inner core portions 11. The composite material molded article 10 is substantially U-shaped, as viewed from above. The pair of inner core portions 11 are respectively arranged inside the pair of wound portions 2*a* and 2*b* when the core member 30 including the composite material molded article 10 is assembled in the coil 2 (FIG. 2). The outer core portion 12 protrudes from the end of the coil 2 when the core member 30 including the composite material molded article 10 is assembled in the coil 2 (FIG. 2) in the same manner. Upper surfaces 11U of the inner core portions 11 are substantially flush with an upper surface 12*u* of the outer core portion 12. On the other hand, the size of the outer core portion 12 is adjusted such that a lower surface 12*d* of the outer core portion 12 is located below lower surfaces 11D of the inner core portions 11 and is substantially flush with the lower surface of the coil 2 when the composite material molded article 10 is assembled in the coil 2. The parting line 15 is formed along substantially the entire periphery of the pair of inner core portions 11 and the outer core portion 12.

Inner Core Portion

It is preferable that the inner core portions 11 have a shape corresponding to the shape of the coil 2 (the shape of the inner space of the coil 2). In this specification, the inner core portions 11 have a rectangular parallelepiped shape, and their corners are rounded off to fit the inner peripheral surfaces of the wound portions 2*a* and 2*b* (FIG. 2). Out of the surfaces of the inner core portion 11, the peripheral surface (surface along the peripheral direction of the wound portions 2*a* and 2*b*) is parallel to a magnetic flux generated in the inner core portion 11, and the parting line 15 is formed to split the peripheral direction of the peripheral surface. In this specification, the peripheral surface includes four flat surfaces, namely the upper surface 11U, the lower surface 11D, a left surface 11L, and a right surface 11R, and four curved surfaces that each couple the adjacent flat surfaces, and the parting line 15 is formed on the left surface 11L and the right surface 11R. An end surface 11E of the inner core portion 11 is continuous with the lateral surfaces and intersects the magnetic flux (at a right angle in this specification).

The parting line 15 extends in parallel to the magnetic flux from one end to the other end on each of the left surface 11L and the right surface 11R. The upper surface 11U and the lower surface 11D are opposed to each other across the parting line 15, and are orthogonal to the left surface 11L and the right surface 11R. Although details will be described later, the parting line 15 corresponds to the parting surface of the mold. Specifically, the regions on the left surface 11L and the right surface 11R excluding the parting line 15 are sliding contact regions that come into sliding contact with the inner surface of the mold, and the upper surface 11U and the lower surface 11D are regions that do not come into sliding contact with the inner surface of the mold. The reason for this is that the mold removal direction is orthogonal to the parting line 15 when the composite material molded article 10 is molded.

The soft magnetic particles are spread on the sliding contact regions on the left surface 11L and the right surface 11R, and the film-like conductive portions in which electrical conduction is established between the soft magnetic particles are thus formed. Therefore, the conductive portions are regions having a low electric resistance (referred to as "low-resistance regions" hereinafter). On the other hand, the upper surface 11U and the lower surface 11D are regions having a high electric resistance (referred to as "high-resistance regions" hereinafter) in which the above-mentioned conductive portions are not substantially formed. In other words, the high-resistance regions (the upper surface 11U and the lower surface 11D) can make it less likely that an eddy current flows on the peripheral surface of the inner core portion 11 in the peripheral direction of the peripheral surface, and can thus block the eddy current. Therefore, eddy current loss can be reduced compared to a composite material molded article in which all of the upper surface, lower surface, left surface and right surface include sliding contact regions.

The ratio of the surface roughnesses of the sliding contact regions (low-resistance regions) on the left surface 11L and the right surface 11R to those of the upper surface 11U and the lower surface 11D (high-resistance regions) is as follows: surface roughnesses of left surface and right surface: surface roughnesses of upper surface and lower surface=approximately 8 to 15:1. An arithmetic average roughness Ra is used as the surface roughness. The same applies hereinafter.

The parting line 15 extends in a continuous manner on the end surface 11E, the left surface 11L, and the right surface 11R of the inner core portion 11. In the same manner as the sliding contact regions on the left surface 11L and the right surface 11R, the regions on the end surface 11E excluding the parting line 15 are sliding contact regions that come into sliding contact with the inner surface of the mold. The surface roughnesses of the sliding contact regions on the end surface 11E are the same as those of the above-described sliding contact regions on the left surface 11L and the right surface 11R. On the end surface 11E of the inner core portion 11, the parting line 15 can block an eddy current flowing on the end surface 11E in the circumferential direction about the magnetic flux, thus making it possible to reduce eddy current loss.

Outer Core Portion

The outer core portion 12 has a substantially trapezoidal columnar shape. The outer core portion 12 includes the upper surface 12*u* and the lower surface 12*d* that are parallel to the magnetic flux, and an outer end surface 12*o* (on a side opposite to the end surfaces 11E of the inner core portions 11) that connects the upper surface 12*u* and the lower surface 12*d* and that is parallel to the magnetic flux. The parting line 15 extends in parallel to the magnetic flux from one end to the other end on the outer end surface 12*o*. The parting line 15 extends in a continuous manner on the outer end surface 12*o* and the inner core portion 11.

In the same manner as the sliding contact regions on the left surface 11L and the right surface 11R, the regions on the outer end surface 12*o* excluding the parting line 15 are sliding contact regions that come into sliding contact with the inner surface of the mold. In the same manner as the upper surface 11U and the lower surface 11D of the inner core portion 11, the upper surface 12*u* and the lower surface 12*d* of the outer core portion 12 are regions that do not come into sliding contact with the inner surface of the mold. The surface roughnesses of the sliding contact regions on the outer end surface 12*o* are the same as those of the above-described sliding contact regions on the left surface 11L and the right surface 11R, and the surface roughnesses of the upper surface 12*u* and the lower surface 12*d* of the outer core portion 12 are the same as those of the upper surface 11U and the lower surface 11D of the inner core portion 11.

Parting Line

The parting line 15 corresponds to the parting surface of the mold. The parting line 15 protrudes outward from the surfaces of the composite material molded article 10. The parting line 15 has a cross-sectional shape in which the base of the parting line 15 is the widest, and the width gradually decreases toward the protruding end. The protruding height and the width of the base of the parting line 15 depend on the shape of the parting surface of the mold and the molding conditions. For example, the parting line 15 has a protruding height of 0.05 mm or more and 10 mm or less, and the base of the parting line 15 has a width of 0.05 mm or more and 1 mm or less. It should be noted that FIG. 1 shows an emphasized projecting state of the parting line 15 for illustrative reasons. The parting line 15 is substantially constituted by resin. Therefore, when the parting line 15 is formed on the end surface 11E of the inner core portion 11 as described above, an eddy current flowing on the end surface 11E is easily blocked.

On the left surface 11L and the right surface 11R of the inner core portion 11, the parting line 15 may be located at the upper end (boundary with the curved surface on the upper surface 11U side), the lower end (boundary with the curved surface on the lower surface 11D side), or the intermediate position (between the upper end and the lower end). On the end surface 11E of inner core portion 11 and the outer end surface 12*o* of the outer core portion 12, for example, the parting line 15 is located at positions that are continuous with the positions on the left surface 11L and the right surface 11R of the inner core portion 11 at which the parting line 15 is located. In this specification, on the left surface 11L and the right surface 11R of the inner core portion 11, the parting line 15 is located at the intermediate position, and on the end surface 11E of inner core portion 11 and the outer end surface 12*o* of the outer core portion 12, the parting line 15 is located at positions that are continuous with the positions on the left surface 11L and the right surface 11R at which the parting line 15 is located. Specifically, the virtual plane surrounded by the parting line 15 is parallel to the magnetic flux (parallel to the direction in which the pair of inner core portions 11 are arranged in parallel), and the parting line 15 is formed to split the composite material molded article 10 in a direction orthogonal to the magnetic flux. It should be noted that, although, in this specification, the parting line 15 has a linear form and is located on one plane, the parting line 15 may have a step portion formed in a step shape or a curved portion formed in a curved shape.

The composite material molded article 10 may include at least one of a resin remelted trace (not shown) and a resin breakage trace (not shown) that are formed at at least a portion of the parting line 15. The remelted trace can be formed through heat treatment, which will be described later. The breakage trace can be formed by breaking the parting line 15 off using a deburring brush, for example.

For example, the remelted trace may be formed in a shape in which (1) the remelted trace has a protruding height lower than that of the parting line 15, but protrudes outward from the surface of the composite material molded article 10, (2) the remelted trace is substantially flush with the sliding contact regions adjacent to the parting line 15, or (3) the remelted trace is recessed from the sliding contact regions. The surface roughness of the remelted trace depends on the method of forming the remelted trace or the shape of the remelted trace. For example, when the remelted trace formed using a laser protrudes from the surface, the ratio between the surface roughnesses of the sliding contact regions on the upper surface 11U and the lower surface 11D, those of the left surface 11L and the right surface 11R, and that of the remelted trace is approximately 1:8 to 15:16 to 30.

On the other hand, the breakage trace is often formed in such a shape that the breakage trace is substantially flush with the sliding contact regions adjacent to the parting line 15. The surface roughness of the breakage trace is larger than those of the surfaces adjacent to the parting line 15. For example, the ratio between the surface roughnesses of the sliding contact regions on the upper surface 11U and the lower surface 11D, those of the left surface 11L and the right surface 11R, and that of the breakage trace is approximately 1:8 to 15:16 to 35.

If the remelted trace or the breakage trace is formed, the contact between the remelted trace or the breakage trace and the coil 2 is easily suppressed when the reactor 1 is formed by assembling the core member 30 of the composite material molded article 10 in the coil 2. Therefore, damage to the conductor of the winding wire 2W of the coil 2 or an insulating coating with which the surface of the conductor is coated is easily suppressed due to the contact therebetween. In addition, the remelted trace or the breakage trace and the coil 2 can be sufficiently spaced apart, thus making it easy to insulate the composite material molded article 10 from the coil 2. The reason for this is that the remelted trace or the breakage trace has a height lower than the protruding height of the parting line 15 as described above. Moreover, the adhesion (joining properties) between the surfaces of the composite material molded article 10 and resin (e.g., a resin molded portion, which will be described later) covering the surfaces is easily increased. The reason for this is that the surface roughness of the remelted trace or the breakage trace is easily increased compared to that of the parting line 15, thus making it easy to increase the contact area of the remelted trace or the breakage trace and the resin. In particular, when the remelted trace is formed, the generation of rust on the soft magnetic powder can be suppressed. The reason for this is that even if the soft magnetic powder is exposed on the parting line 15, the resin can be fluidized through heat treatment performed when the remelted trace is formed, thus making it possible to embed the exposed soft magnetic powder in the resin.

As the heat treatment for forming the remelted trace, contact heat treatment in which a heating medium is brought into direct contact, or indirect heat treatment in which the heating medium is not brought into contact is used. Examples of means for the contact heat treatment include ultrasonic heating, hot-plate heating, and an impulse welder. The ultrasonic heating is a means for heating the parting line 15 with frictional heat generated by using a horn (heating medium) to transmit ultrasonic vibration generated by an ultrasonic generator and an ultrasonic transducer to the surface of the parting line 15. The hot-plate heating is a means for heating the parting line 15 by bringing a heated metal plate (heating medium) into contact with the parting line 15. The impulse welder is a means for heating the parting line 15 with heat generated by applying a instantaneous large current to a pressurized heater wire (heating medium) provided on the parting line 15. On the other hand, an example of the indirect heat treatment is optical heating. Examples of the optical heating include laser heating and infrared heating using temperature radiation. Depending on the width of the parting line 15, an example of a laser processing width is 0.1 mm or more and 10 mm or less. The energy density U ($W/mm^2$) of a laser is shown by the equation U=P/S where P (W) is the average laser output and S ($mm^2$) is the laser radiation area, and it is preferable that this energy density U satisfies $2\ W/mm^2 \leq U \leq 450\ W/mm^2$. When the energy density U is 2 $W/mm^2$ or more, the resin in the parting line 15 can be sufficiently remelted. On the other hand, when the energy density U is 450 $W/mm^2$ or less, contact between the soft magnetic particles due to excessive melting can be sufficiently suppressed.

Constituent Materials

Soft Magnetic Powder

Examples of the materials for the soft magnetic powder include soft magnetic materials such as iron group metals, Fe-based alloys containing Fe as a main component, ferrites, and amorphous metals. It is preferable to use the iron group metals and the Fe-based alloys as the materials for the soft magnetic powder from the viewpoint of an eddy current loss and saturation magnetization. Examples of the iron group metals include Fe, Co, and Ni. In particular, Fe is preferably pure iron (containing inevitable impurities). Since Fe has a high saturation magnetization, the saturation magnetization of the composite material can be increased as the Fe content is increased. The Fe-based alloys contain one or more elements selected from Si, Ni, Al, Co, and Cr as additional elements in an amount of 1.0 mass % or more and 20.0 mass % or less in total, and Fe and inevitable impurities as the balance, for example. Examples of the Fe-based alloys include an Fe—Si based alloy, an Fe—Ni based alloy, an Fe—Al based alloy, an Fe—Co based alloy, an Fe—Cr based alloy, and an Fe—Si—Al based alloy (sendust). In particular, the Fe-based alloys containing Si such as the Fe—Si based alloy and the Fe—Si—Al based alloy have a high electric resistivity, easily reduce eddy current loss, and have a small hysteresis loss, thus making it possible to reduce the iron loss of the composite material molded article 10. When the Fe—Si based alloy is used, for example, the Si content is 1.0 mass % or more and 8.0 mass % or less, for example, and preferably 3.0 mass % or more and 7.0 mass % or less. The soft magnetic powder may be a mixture of a plurality of types of powder made of different materials. An example thereof is a mixture of Fe powder and Fe-based alloy powder.

The soft magnetic powder has an average particle diameter of preferably 5 μm or more and 300 μm or less, and more preferably 10 μm or more and 100 μm or less. When the soft magnetic powder has an average particle diameter of 5 μm or more, the soft magnetic powder is less likely to coagulate, and resin is easily provided sufficiently between the powder particles, thus making it easy to reduce an eddy current loss. When the soft magnetic powder has an average particle diameter of 300 μm or less, eddy current loss of the particles can be reduced, and eddy current loss of the composite material molded article 10 can be thus reduced. In addition, the filling factor can be increased, and the saturation magnetization of the composite material molded article 10 is easily increased. The soft magnetic powder may be a mixture of a plurality of types of powder that differ in particle diameter. When soft magnetic powder obtained by mixing fine powder and coarse powder is used as the material for the composite material molded article 10, a low-loss reactor 1 having a high saturation magnetic flux density is easily obtained. When soft magnetic powder obtained by mixing fine powder and coarse powder is used, it is preferable that the soft magnetic powder contains different types of materials, one of which is Fe and the other of which is an Fe-based alloy, for example. When the two types of materials for powder are different, both the characteristics of Fe (high saturation magnetization) and the characteristics of an Fe-based alloy (high electric resistance that facilitates the reduction of eddy current loss) are provided, and the effect of improving saturation magnetization and an iron loss are well balanced. When the two types of materials for powder are different, either the coarse powder or the fine powder may be made of Fe (Fe-based alloy), but it is preferable that the fine powder is made of Fe. In other words, it is preferable that the coarse powder is made of an Fe-based alloy. This achieves a lower iron loss compared to the case where the fine powder is made of an Fe-based alloy and the coarse powder is made of Fe. Insulating coatings may be provided on the surfaces of the particles of the soft magnetic powder in order to improve the insulation. The soft magnetic powder may be subjected to surface treatment (e.g., silane coupling treatment) for improving the compatibility with the resin or the dispersability in the resin.

The content of the soft magnetic powder in the composite material molded article 10 is preferably 30 vol % or more to 80 vol % or less with respect to 100 vol % of the composite material molded article 10. When the content of the soft magnetic powder is 30 vol % or more, the ratio of the magnetic component is sufficiently high. Therefore, when this composite material molded article 10 is used to form the reactor 1, saturation magnetization is easily increased. The larger this content is, the relatively smaller the content of the resin is. Therefore, the conductive portions in which electrical conduction is established between the particles are likely to be formed in the above-mentioned sliding contact regions. However, the composite material molded article 10 includes the above-mentioned high-resistance regions (upper surface 11U and lower surface 11D), and therefore, eddy current loss can be reduced even when the content of the soft magnetic powder is large. When the content of the soft magnetic powder is 80 vol % or less, the ratio of the magnetic component is not excessively high, and therefore, the insulation between the soft magnetic particles can be increased, thus making it possible to reduce eddy current loss. Moreover, the mixture of the soft magnetic powder and the resin has a good fluidity, and a good productivity of the composite material molded article 10 is thus achieved. The content of the soft magnetic powder is set to 50 vol % or more, preferably 55 vol % or more, and more preferably 60 vol % or more, for example. The content of the soft magnetic powder may be set to 75 vol % or less, and preferably 70 vol % or less, for example.

Resin

Examples of the resin include thermosetting resins such as epoxy resin, phenol resin, silicone resin, and urethane resin, and thermoplastic resins such as polyphenylene sulfide (PPS) resin, polyamide resin (e.g., nylon 6, nylon 66, and nylon 9T), liquid crystal polymers (LCP), polyimide resin, and fluororesin. In addition, cold setting resins, bulk molding compounds (BMCs) obtained by mixing calcium carbonate or glass fiber to unsaturated polyester, millable-type silicone rubber, millable-type urethane rubber, and the like can also be used.

Other Considerations

The composite material molded article 10 may contain powder (filler) made of a non-magnetic material such as ceramic including alumina, silica, and the like in addition to the soft magnetic powder and the resin. The filler contributes to the improvement of a heat dissipating property, and the suppression of uneven distribution of the soft magnetic powder (i.e., uniform dispersion thereof). Moreover, when a fine filler is used and provided between the soft magnetic particles, the reduction of the ratio of the soft magnetic powder due to the filler being contained can be suppressed. The content of the filler is preferably 0.2 mass % or more and 20 mass % or less, more preferably 0.3 mass % or more and 15 mass % or less, and even more preferably 0.5 mass % or more and 10 mass % or less, with respect to 100 mass % of the composite material.

Application

The composite material molded article 10 can be favorably used for a magnetic core of various magnetic components (e.g., a reactor, a choke coil, a transformer, and a motor), and a material thereof.

Manufacturing Method

The composite material molded article 10 can be manufactured through injection molding, heat press molding, or MIM. Although not shown in the figures, a mold in which the parting surface is parallel to a magnetic flux generated in the composite material molded article 10 and the mold removal direction is orthogonal to the magnetic flux is used to manufacture the composite material molded article 10.

Functions and Effects of Composite Material Molded Article

With the above-described composite material molded article 10, the high-resistance regions extending in the direction of the magnetic flux are provided on the upper surface 11U and the lower surface 11D, which are parallel to the magnetic flux generated in the inner core portion 11, and therefore, the high-resistance regions can make it less likely that an eddy current flowing in the circumferential direction about the magnetic flux flows on the lateral surfaces of the inner core portion 11. Therefore, eddy current loss can be reduced, and a low-loss reactor can be thus formed.

Reactor

The above-described composite material molded article 10 can be favorably used in at least a portion of the magnetic core 3 of the reactor 1 shown in FIG. 2. As described at the beginning of Embodiment 1, the reactor 1 includes the coil 2 including the pair of wound portions 2*a* and 2*b* and the magnetic core 3 constituted by the two core members 30 having the same shape. The core members 30 are constituted by the above-described composite material molded articles 10.

Coil

The pair of wound portions 2*a* and 2*b* are obtained by spirally winding the winding wire 2*w*, which is a single continuous wire having no joined portions, and coupled to each other via a coupling portion 2*r*. A coated wire in which the outer circumference of a conductor such as a flat wire or a round wire made of a conductive material such as copper, aluminum, or an alloy thereof is coated with an insulating coating made of an insulating material can be favorably used as the winding wire 2*w*. In this embodiment, a coated flat wire in which the conductor is a flat wire made of copper and the insulating coating is made of enamel (typically polyamideimide) is used. Each of the wound portions 2*a* and 2*b* is constituted by an edgewise coil obtained by winding this coated flat wire in an edgewise manner. The wound portions 2*a* and 2*b* are arranged in parallel (in a lateral direction) such that their axis directions are parallel to each other. The wound portions 2*a* and 2*b* have the same winding number and have a hollow tubular shape (quadrilateral tube). The end surfaces of the wound portions 2*a* and 2*b* have a shape obtained by rounding the corners of a rectangular frame. The coupling portion 2*r* is formed by bending a portion of the winding wire into a U shape at one end of the coil 2 (right side of the plane of FIG. 2). The upper surface of the coupling portion 2*r* is substantially flush with the upper surface of a turn forming portion of the coil 2. Both ends 2*e* of the winding wire 2*w* of the wound portion 2*a* and 2*b* extend from the turn forming portion. Both ends 2*e* are connected to terminal members (not shown), and an external apparatus (not shown) such as a power source that supplies power to the coil 2 is connected via these terminal members.

Magnetic Core

The pairs of inner core portions 11 of the respective core members 30 are arranged inside the pair of wound portions 2*a* and 2*b* when the core members 30 are assembled in the coil 2. The outer core portions 12 of the core members 30 are arranged to project from the coil 2 when the core members 30 are assembled in the coil 2 in the same manner. The annular magnetic core 3 is formed by coupling the end surfaces 11E (interlinkage surfaces) of the inner core portions 11 of one of the core members 30 to the end surfaces 11E (interlinkage surfaces) of the inner core portions 11 of the other of the core members 30 inside the wound portions 2*a* and 2*b*. With this coupling of the core members 30, when the coil 2 is excited, a closed magnetic circuit is formed, and magnetic fluxes extend in parallel to the longitudinal direction of the inner core portions 11 and intersect the interlinkage surfaces at a right angle. The core members 30 may be coupled without providing gap materials between the interlinkage surfaces of the inner core portions 11, or by providing gap materials therebetween. An adhesive can be used to couple the core members 30. Gaps (air gaps) may be provided between the core members 30. Examples of the material of the gap material include materials having a magnetic permeability lower than that of the core members 30, including non-magnetic materials such as alumina and unsaturated polyester, and mixtures containing a non-magnetic material such as a PPS resin and a magnetic material (e.g., iron powder).

Other Considerations

Resin Molded Portion

The magnetic core 3 further includes a resin molded portion that covers the surfaces of the core member 30. When the parting line 15 of the core member 30 includes a remelted trace or a breakage trace, the adhesion of the resin molded portion to the core member 30 can be increased. The entire region of the surfaces of the core member 30 can be covered with the resin molded portion, for example. Examples of the constituent material of the resin molded portion include the following thermoplastic resins and thermosetting resins in addition to the same thermoplastic resins (e.g., PPS resin) and thermosetting resins as the resin of the above-described composite material molded article 10. Examples of the thermoplastic resins include a polytetrafluoroethylene (PTFE) resin, a polybutylene terephthalate (PBT) resin, and an acrylonitrile-butadiene-styrene (ABS) resin. An example of the thermosetting resins is an unsaturated polyester resin. These constituent resins may contain a ceramics filler such as alumina and silica. This provides a good thermal conductivity to the resin molded portion, and the heat dissipation properties of the reactor 1 can be thus increased.

Application

The reactor 1 can be favorably used in constituent components of various types of converters such as vehicle-mounted converters (typically DC-DC converters) to be mounted in vehicles including hybrid cars, plug-in hybrid cars, electric cars, fuel cell cars, and the like, and converters for an air conditioner, and constituent components of power conversion devices.

Functions and Effects of Reactor

With the above-described reactor 1, the core member includes the composite material molded article including the high-resistance regions extending in the direction of the magnetic flux, on the surfaces parallel to the magnetic flux, and the high-resistance regions can make it less likely that an eddy current flows. Therefore, the reactor 1 is a low-loss reactor.

TEST EXAMPLES

Samples of composite material molded articles including soft magnetic powder and resin containing the soft magnetic powder in a dispersed state were prepared, and the magnetic characteristics of the samples were evaluated. The same constituent materials were used in all the samples. Fe—Si alloy powder having an average particle diameter of 80 μm and containing Si in an amount of 6.5 mass % and Fe and inevitable impurities as the balance was used as the soft magnetic powder. A PPS resin was used as the resin. The soft magnetic powder and the resin were mixed, and then the resin was melted. In this state, the resin and the soft magnetic powder were kneaded together to produce a mixture. The content of the soft magnetic powder in the mixture was set to 70 vol %.

Sample No. 1-1

As a composite material molded article of Sample No. 1-1, a U-shaped composite material molded article 10 shown FIG. 1 including a pair of inner core portions 11 and an outer core portion 12 was produced through injection molding. A mold in which the parting surface is parallel to a magnetic flux, that is, a mold in which the mold removal direction is orthogonal to the magnetic flux, was prepared and filled with the above-mentioned mixture. The mixture was cooled and solidified, and the composite material molded article was thus produced. The parting surface of the mold was formed at a substantially central position between the upper surface 11U and the lower surface 11D of the inner core portion 11. The parting line 15 of the composite material molded article 10 of Sample No. 1-1 was formed on the left surfaces 11L, right surfaces 11R, and end surfaces 11E of the inner core portions 11, and the outer end surface 12*o* of the outer core portion 12. The composite material molded article of Sample No. 1-1 was used as it was when removed from the mold, that is, the parting line 15 remained as it was when formed.

Sample No. 1-2

A composite material molded article of Sample No. 1-2 was produced by performing laser processing on the parting line 15 of the composite material molded article 10 of Sample No. 1-1. Specifically, the composite material molded article of Sample No. 1-2 was different from the composite material molded article of Sample No. 1-1 in that a resin remelted trace was formed on the parting line. In this specification, the laser processing was performed on the entire portion of the parting line 15 on the left surface 11L and the entire portion thereof on the end surface 11E in the left inner core portion 11, and the entire portion of the parting line 15 on the right surface 11R and the entire portion thereof on the end surface 11E in the right inner core portion 11. The laser processing was performed under the conditions that the processing width was 3 mm and the laser energy density was 5.5 W/mm$^2$. In the composite molded article of Sample No. 1-2, resin remelted traces were formed on the parting line 15 on the right surface 11R of the right inner core portion 11 and the left surface 11L of the left inner core portion 11.

Sample No. 1-101

A composite material molded article of Sample No. 1-101 was produced using a mold that differed from the mold used for Sample No. 1-1 in the position of the parting surface, that is, the mold removal direction. Specifically, a mold was used in which the parting surface is orthogonal to the magnetic flux, that is, the mold removal direction is parallel to the magnetic flux. In this specification, the parting surface was set to be located at the boundary between the pair of inner core portions and the outer core portion. In the composite material molded article of Sample No. 1-101, the parting line was formed on the entire periphery (entire region) of the boundary between the two inner core portions and the outer core portion.

Magnetic Characteristics

A copper wire was wound around an annular test piece obtained by combining two composite material molded articles of each sample, and a measurement member provided with a primary winding coil with 300 turns and a secondary winding coil with 20 turns were thus produced. The iron loss W4/20k (W) of each measurement member was measured at an excited magnetic flux density Bm of 4 kG (=0.4 T) and a measurement frequency of 20 kHz using an AC-BH curve tracer. Table 1 shows the results.

TABLE 1

| Sample No. | Parting surface of mold | Mold removal direction | Processing of parting line | Iron loss W4/20k (W) |
|---|---|---|---|---|
| 1-1 | Parallel to magnetic flux | Orthogonal to magnetic flux | None | 8.9 |
| 1-2 | Parallel to magnetic flux | Orthogonal to magnetic flux | Laser | 8.5 |
| 1-101 | Orthogonal to magnetic flux | Parallel to magnetic flux | None | 9.8 |

As shown in Table 1, the iron losses of Samples 1-1 and 1-2 were 8.9 W and 8.5 W, respectively, and the iron loss of Sample No. 1-101 was 9.8 W. In this manner, the iron losses of Samples 1-1 and 1-2 were lower than that of Sample No. 1-101, and the iron loss of Sample No. 1-2 was lower than that of Sample No. 1-1.

A possible reason for the result in which the iron losses of Sample No. 1-1 and 1-2 were lower than that of Sample 1-101 is that, in the composite material molded articles of Samples No. 1-1 and 1-2, eddy current losses were more effectively reduced than in that of Sample No. 1-101. Since the composite material molded articles of Samples No. 1-1 and 1-2 were produced using the mold in which the parting surface is parallel to the magnetic flux, that is, the mold removal direction is orthogonal to the magnetic flux, the high-resistance regions in which no conductive portions were formed were formed on the upper surface and the lower surface, which are parallel to the magnetic flux. Therefore, the high-resistance regions made it less likely that an eddy current flowing in the circumferential direction about the magnetic flux flowed on the lateral surfaces of the inner core portion. On the other hand, since the composite material molded article of Sample No. 1-101 was produced using the mold in which the parting surface is orthogonal to the magnetic flux, that is, the mold removal direction is parallel to the magnetic flux, the entire regions of the surfaces parallel to the magnetic flux came into sliding contact with the inner surface of the mold, and the low-resistance conductive portions were thus formed on all the surfaces parallel to the magnetic flux. Therefore, an eddy current was likely to flow on the lateral surfaces of the inner core portion in the circumferential direction about the magnetic flux, and the flow of the eddy current could not be suppressed.

A possible reason for the result in which the iron loss of Sample No. 1-2 was lower than that of Sample No. 1-1 is that, in the composite material molded article of Sample No. 1-2, eddy currents flowing on the end surfaces 11E of the left and right inner core portions 11 were more effectively reduced than in that of Sample No. 1-1. In the composite material of Sample No. 1-2, the laser processing was also performed on the entire portions of the parting lines 15 on the end surfaces 11E of the left and right inner core portions 11, and therefore, eddy currents could be made less likely to flow on these end surfaces 11E compared to Sample No. 1-1.

The present invention is not limited to these embodiments and is defined by the scope of the appended claims, and all changes that fall within the same essential spirit as the scope of the claims are intended to be included therein. For example, the shape of the core member can be selected as appropriate depending on the combinations of a plurality of core members in a magnetic core. A plurality of core members can be combined to form a so-called L-L (J-J) type core in which one inner core portion is integral with the outer core portion, other than the above-described U-U type core. Moreover, a reactor including a coil with a single wound portion and a magnetic core called an E-E type core or an E-I type core can also be formed.

The invention claimed is:

1. A composite material molded article including soft magnetic powder and resin containing the soft magnetic powder in a dispersed state, the composite material molded article comprising:

a parting line corresponding to a parting surface of a mold for molding the composite material molded article; and an inner core portion to be arranged inside a coil, wherein the soft magnetic powder is contained in the composite material molded article in an amount of 30 vol % or more and 80 vol % or less with respect to the whole amount of the composite material molded article, an outer surface includes a peripheral surface extending along a circumferential direction of a magnetic flux excited in the inner core portion by the coil among surfaces of the inner core portion, and the parting line is formed to split a peripheral direction of the peripheral surface, wherein the parting line is a continuous bead extending beyond the peripheral surface and radial to the direction of the magnetic flux.

2. The composite material molded article according to claim 1, comprising a remelted trace of the resin formed on at least a portion of the parting line.

3. The composite material molded article according to claim 1, comprising a breakage trace formed on at least a portion of the parting line.

4. The composite material molded article according to claim 1, comprising:

a pair of the inner core portions arranged in parallel; and an outer core portion that is to be arranged outside the coil and that connects the inner core portions, wherein the peripheral surface on which the parting line extends is orthogonal to a direction in which the pair of the inner core portions are arranged in parallel.

5. The composite material molded article according to claim 1, wherein the soft magnetic powder contains soft magnetic particles made of an Fe-based alloy that contains Si in an amount of 1.0 mass % or more and 8.0 mass % or less.

6. The composite material molded article according to claim 1, wherein the soft magnetic powder has an average particle diameter of 5 μm or more and 300 μm or less.

7. A reactor comprising:

a coil obtained by winding a winding wire; and a magnetic core around which the coil is arranged, wherein at least a portion of the magnetic core includes the composite material molded article according to claim 1.

* * * * *